United States Patent [19]

Fisk et al.

[11] 3,977,481

[45] Aug. 31, 1976

[54] BORING APPARATUS

[75] Inventors: Allan T. Fisk, Salem; Carl R. Peterson, Boxford, both of Mass.

[73] Assignee: Rapidex, Inc., Gloucester, Mass.

[22] Filed: June 9, 1975

[21] Appl. No.: 585,452

Related U.S. Application Data

[63] Continuation-in-part of Ser. No. 448,245, March 5, 1974, Pat. No. 3,897,837.

[52] U.S. Cl. ..... 175/228; 175/345; 308/8.2

[51] Int. Cl.[2] ..... E21B 9/24

[58] Field of Search ..... 175/228, 334, 335, 336, 175/337, 339, 340, 344–348, 353, 359, 371, 374, 382; 308/8.2

[56] References Cited

UNITED STATES PATENTS

| | | | |
|---|---|---|---|
| 1,139,529 | 5/1915 | Hughes | 175/227 |
| 1,474,633 | 11/1923 | Hughes | 175/227 |
| 1,487,319 | 3/1924 | Duda | 175/228 |
| 1,577,810 | 3/1926 | Raymond | 175/227 |
| 1,708,288 | 4/1929 | Wadsworth | 175/227 |
| 2,831,660 | 4/1958 | Smiecinski | 175/228 |
| 3,463,270 | 8/1969 | Lundstrom et al. | 308/8.2 |
| 3,494,432 | 2/1970 | Garrett | 175/345 |

*Primary Examiner*—James A. Leppink

[57] ABSTRACT

Boring apparatus having a plurality of hole-enlarging assemblies comprising shaft-mounted working members. In a convergent arrangement of the axes of the working members the assemblies are completed by insertion of the elongated shafts via a hollow space in the bottom connector, through passages in the frame. The upper ends of the shafts are shown held in holes in the frame, and the exterior upper and lower surfaces of the frame are shown as surfaces of revolution, free of wear points. The passages are shown to form cut-outs in the thread of the connector in the first preferred embodiment. In other embodiments the passages are formed through an extension of the frame preceding the connector, and a two-part connector assembly is provided, the passage entering a hollow space provided by the outer part. Also shown, in a boring apparatus, are self-contained lubrication systems in the shafts of each of a multiplicity of rock boring assemblies, with lubricant pressurized by the flushing fluid, as by flid passing through the shaft, and lubrication fill points at the ends of the shafts, preferably accessible through the hollow space of the bottom connector.

17 Claims, 11 Drawing Figures

FIG 4
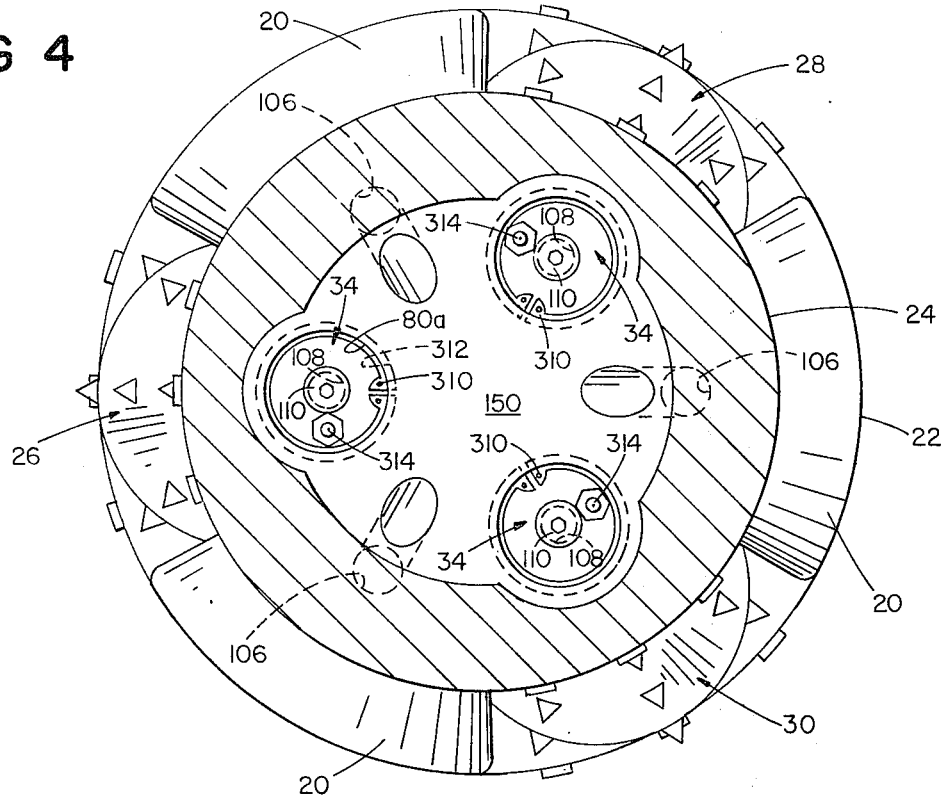
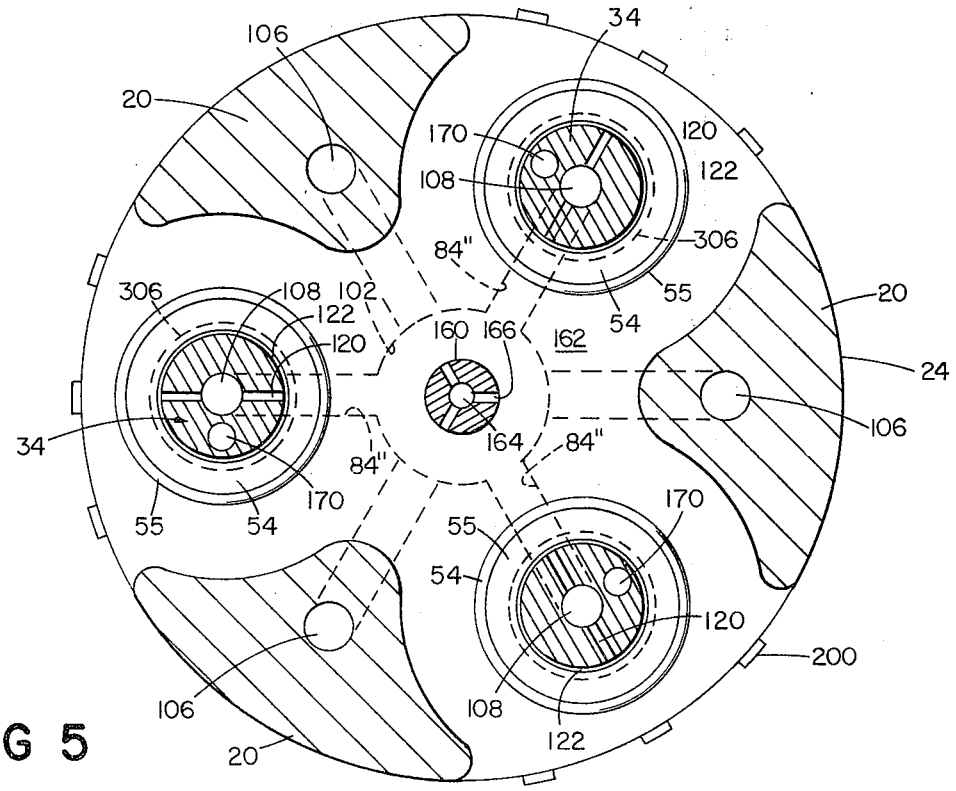
FIG 5

FIG 6
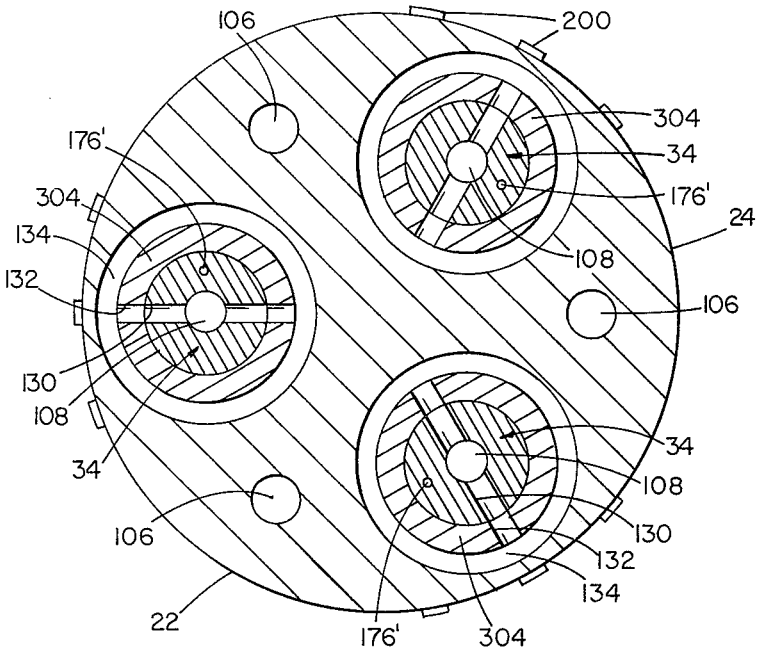
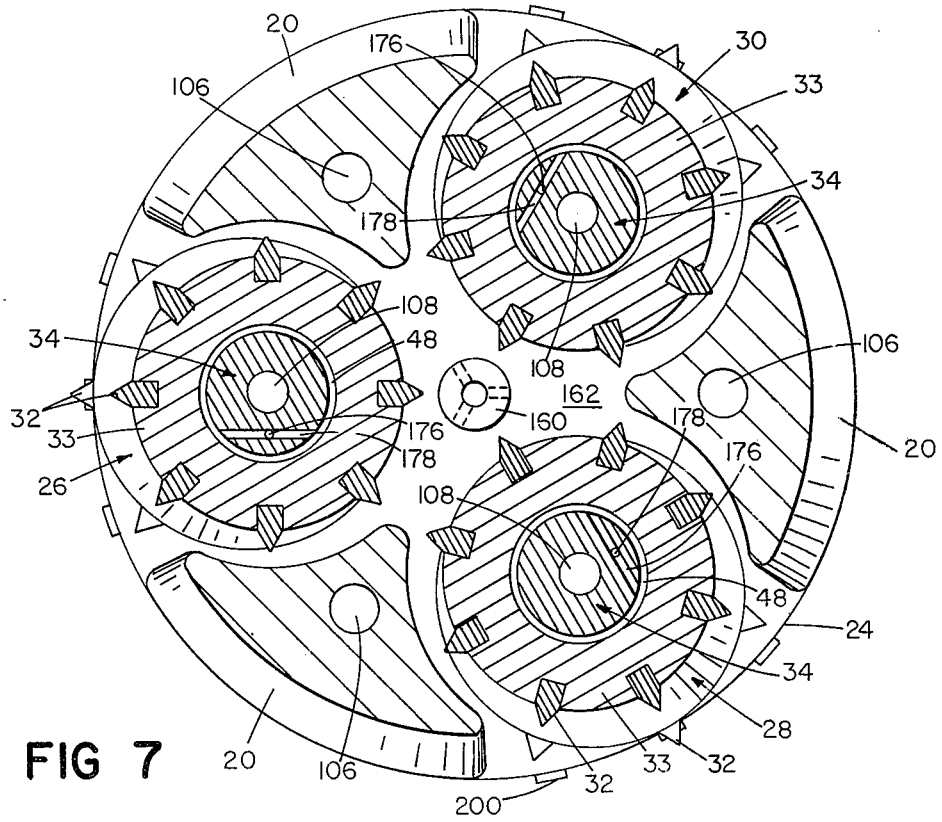
FIG 7

BORING APPARATUS

This application is a continuation-in-part of co-pending application Ser. No. 448,245 filed Mar. 5, 1974 and now issued as U.S. Pat. No. 3,897,837.

BACKGROUND OF THE INVENTION

This invention relates to boring apparatus useful, e.g., in earth or rock.

Typically such apparatus has a frame supported at the lower end of a drill pipe string, with a pilot bit mounted at the bottom of the frame and reamers for enlarging the pilot hole mounted on the frame above the pilot bit.

A number of considerations enter into the building of such boring apparatus. The apparatus should be strong, be capable of withstanding high torque and of boring fast through hard rock, and should not break apart in the bore hole; on the other hand the apparatus should be of limited diameter to fit the hole produced and should be inexpensive, have few parts, be simple, not require undue maintenance and have long life. Difficulties arise in discovering designs to balance these somewhat conflicting considerations to improve the efficiency of use of the capital invested.

Of the various prior known designs, two having some similarity with the present invention will be mentioned.

In one reamer-stabilizer design, having rollers for engaging the side walls of the bore hole, it was suggested that the rollers be mounted permanently, enabling the exterior frame surfaces above and below the rollers to be formed as smooth surfaces of revolution, avoiding discontinuities that constitute wear points in the harsh hole bottom environment where the frame bears continuously against the jagged rock walls. See U.S. Pat. No. 3,306,379.

Drawbacks of the design are that it does not take a large cut and must be discarded when any of the bearings, shafts or cutters fail, despite useful life remaining in the main frame and other parts.

In another design the rollers are arranged in conical configuration on axes that converge downwardly. Each roller has integral stub-shafts at both ends, the upper stub shaft held in a discrete bearing block bolted to the frame and the lower stub shaft held in a large bearing inserted into the frame. In the steps of assembly, each roller is placed in position with its lower stub shaft protruding downwardly into a hole in the frame, the lower bearing is slipped upwardly from below through a passage that has been pre-drilled from the frame bottom, and the upper bearing block is assembled upon the upper stub shaft and bolted in place. Thereafter a threaded connector for the pilot bit is bolted to the frame.

This design has the advantage over the previous one mentioned of taking a larger cut. But the various exposed bolts and pieces suffer such damage during rotation against the rock that the rollers cannot thereafter be removed, hence the useful life of the entire assembly is again limited to that of the roller cutters.

SUMMARY OF THE INVENTION

The invention, in various aspects, provides compact (particularly along the drilling axis), rugged, inexpensive apparatus capable of efficient boring. Improvements are provided in the means of assembly and protection of cutter retaining elements, as well as in lubrication and protection of the bearing systems in the hole-enlarging assemblies.

One aspect of the invention concerns boring apparatus having a plurality of hole-enlarging assemblies mounted on the frame with separate axes of rotation converging downwardly toward the primary axis and the frame having a connection means at its bottom for supporting a further element of the drill string. According to the invention, each hole-enlarging assembly has a working member rotatable about its respective axis of rotation upon an elongated through-shaft associated with a passage which extends through the frame downwardly from the assembly, along the respective converging axis to a hollow space in the connection means. The hollow space and passage are correspondingly sized and clear of obstruction to enable insertion of the elongated shaft upwardly through the space to pass through the working member, to an upper support point, and a retaining means is introduced through the hollow space to retain the shaft in position. This construction enables simple manufacture and assembly in a sturdy manner with various advantages. In preferred embodiments thereof the exterior of the frame is free of removable connections exposed to the bottom hole environment, and the retaining means is removable to permit removal of the shaft through the hollow space and replacement of parts of the assembly, the removable retaining means and the respective end of the shaft being protected from the bottom hole environment by the connection means and the further element supported by it; the upper and lower ends of the shaft are retained respectively by integral upper and lower portions of the frame, these portions as well as the connection means having external surfaces in the general form of surfaces of revolution free of concentrated wear points, preferably the external surfaces provided with hard wear-resistant inserts; the connection means defines an internal thread, the passages along the converging axes passing partially through upper portions of the thread; alternatively the frame includes an integral hollow extension preceding the connection means, the opening from the space of the connection means to the passage being through the inside wall of the extension.

According to another feature of the invention, in boring apparatus having a plurality of shaft-mounted working members, each shaft contains its own lubricant reservoir, and a lubricant fill point is provided at the lower end of the shaft, accessible for refilling through a passage extending upwardly from the hollow space of a bottom connection means. Conduits through the shaft extend from the reservoir to the bearings that support the working member on the shaft. In preferred embodiments a passage is provided exposing a movable pressurizing member in the reservoir in the shaft to pressurized flushing fluid to pressurize lubricant in the shaft; preferably, when the flushing fluid is compressed air, a fluid passage extends through each shaft to a flushing outlet, and a conduit from the fluid passage applies compressed air to the pressurizing member of the reservoir; preferably when the flushing fluid is recycled mud the fluid does not pass through the shaft, but a limited filtered quantity enters to apply hydraulic pressure to the movable pressurizing member. With either flushing fluid the pressurizing member may be a piston movable in a stroke within the working-member support shaft, or it may be a deflectable diaphragm movable within the shaft. In all such cases seals are provided at ends of the working members to protect bearings there-within and the lubricating passages and pressurizing system ensure proper lubricant pressure relative to the ambient pressure on the opposite side of the seal whereby the seal and bearing are protected from rock chips in the flushing fluid.

Other advantages and features of the invention will be apparent from the description and drawings herein of a preferred embodiment thereof.

BRIEF DESCRIPTION OF THE DRAWINGS

FIGS. 4–7 are sectional views taken respectively along 4—4, 5—5, 6—6, and 7—7, of FIG. 1;

DESCRIPTION OF THE PREFERRED EMBODIMENT

Figure 1:
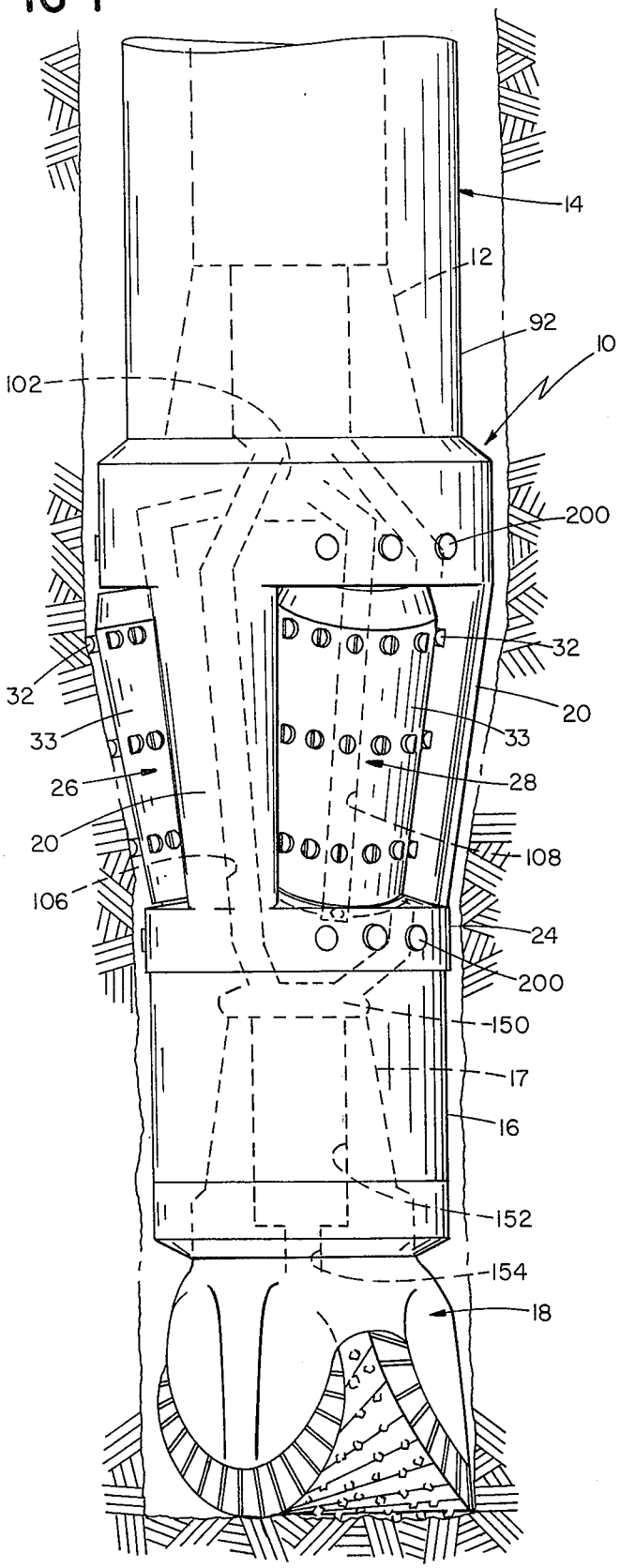
FIG. 1 is a side elevation of apparatus embodying the invention, connected to a fragment of a pipe string.

Referring to the drawings, there is shown a main frame 10 connected at its top through externally threaded connector 12 to pipe string 14 which extends back to the surface drill rig, and at its bottom through internally threaded connector 16 to conventional tricone pilot bit 18. Frame 10 tapers from top to bottom along three circumferentially spaced struts 20 extending between upper and lower frame portions 22 and 24. Three cutters 26, 28, and 30 are respectively arranged between struts 20.

Figure 2:
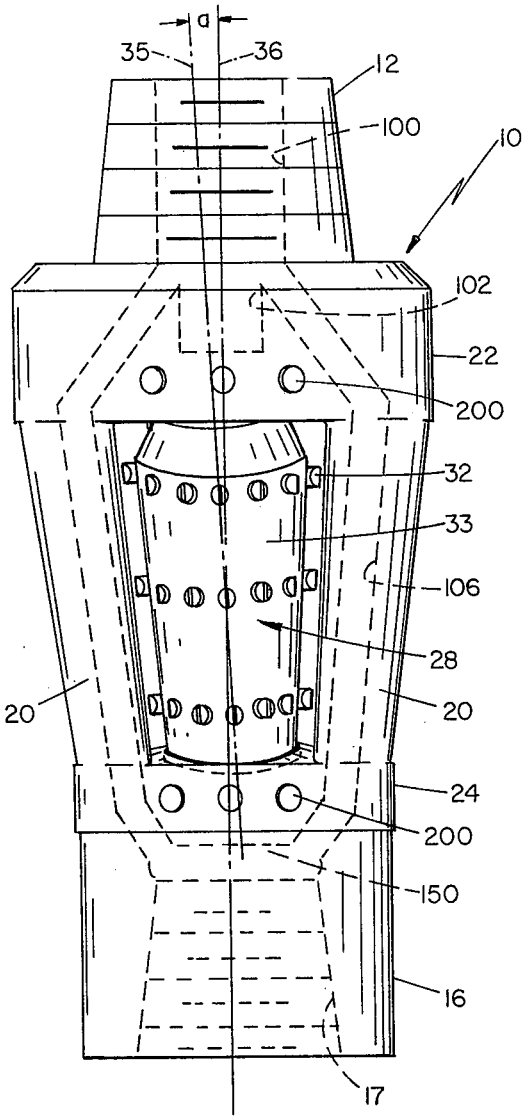
FIG. 2 is a view similar to FIG. 1, from a different angle, with the pipe string and pilot bit omitted.

Each cutter has tooth inserts 32 in a body 33 mounted to rotate about shaft 34 (FIG. 3) having an axis 35 which not only generally follows the taper of struts 20 but is also skewed (e.g., by angle *a*, 2°–4°, FIG. 2) with respect to the vertical axis 36 of frame 10. In overall operation rotation of frame 10 causes cutters 26, 28, and 30 to rotate and to enlarge the pilot hole produced by bit 18. The skew of the cutters produces vertical force components between the hole wall and the cutters, causing the apparatus to be at least partially self-advancing.

Body 33 of each cutter is tapered where it receives inserts 32, and has fixed and sealed to itself in counterbores 40 and 42 annular upper and lower thrust bearings 44 and 46 and, on the inside cylindrical surface of its central bore 48, axially spaced radial bearing inserts 50 and 52. The upper thrust bearing 44 runs against a pair of washers 54 which bear against frame 10. "O" ring 55 is stretched around washers 54, resting in a groove formed by mating chamfers on the outside diameter of washers 54, tending to force washers 54 apart axially and in firm contact with upper bearing 44 and frame 10 despite any axial movement of cutters 26, 28, 30 that may occur. Lower thrust bearing 46 runs against surface 302 of shaft bushing 304 inserted in frame portion 24 of frame 10. Shaft bushings 304 are a tight press fit in frame portion 24 and do not move in service.

Upper and lower O-rings 62 and 64 respectively provide the primary dynamic seals between stationary shaft 34 and the rotating cutter body. Static seal 70 between the shaft bushing 304 and shaft 34 and static seal 306 between frame 10 and shaft 34 keep dirt out of the internal system and prevent leakage of fluid from the internal passages.

The lower ends of shafts 34 extend into cylindrical bores 80 in the shaft bushings 304. The upper shaft ends are notched at 82 (and at 82′, to allow for 180° rotation of the shaft after wear) to receive cylindrical pins 84, which hold each shaft in place and prevent it from rotating. Pin 84 is pressed and welded in bore 84′ of frame 10 which intersects bore 308 in which shaft 34 is fitted. Extension 84″ of bore 84′ communicates with axial fluid inlet passage 100 in frame 10. Threaded pipe string portion 14 is screwed on connector 12.

Provision is made for supplying flushing fluid (e.g., air, clear water, or mud, etc.) to pilot bit 18 and to cutters 26, 28, and 30, to flush the rock removed during the drilling process. Thus, axial fluid inlet passage 100 communicates with notch 82′ in each shaft 34 and an axial passage 106 in each strut 20. (The second notch 82 of shaft 34 is so used when the shaft is rotated.) Notch 82′ in turn feeds axial passage 108 within the shaft. Plug 110 seals the bottom of passage 108 but may be removed for cleaning passage 108 if necessary.

Axial passage 108 communicates in the region of upper thrust bearing 44, through radial holes 120 in shaft 34, with generally annular buffer chamber 122 formed between washers 54 and shaft 34, just above upper thrust bearing 44. Leakage between washers 54 and thrust bearing 44, and between washers 54 and frame 10, provides for a continuous small escape of fluid from the buffer chamber, so that clean fluid is always kept outside seal 62, despite the dirty environment in which the apparatus operates.

Just below lower thrust bearing 42 passage 108 communicates, through radial holes 130 in shaft 34 and aligned radial holes 132 in the shaft bushing 304, with annular buffer chamber 134. Relatively large clearance 136 (e.g., 0.02 inch) is provided between cutter body 33 and frame portion 24, so that a substantial amount of fluid flows through chamber 134 and upwardly past teeth 32. Not only is clean fluid thus kept outside of seal 64, but the cutter is cooled, the conical portion of the hole being drilled is flushed, and the jet pump effect of the upwardly flowing fluid helps to draw upwardly further chips and fluid from the region of the pilot bit. The relative rotation between the opposing nozzle-defining walls of clearance 136 gives the nozzle an advantageous self-cleaning quality in use.

Strut passages 106 communicate with lower plenum 150. Plenum 150 in turn communicates with axial passage 152 (FIG. 1) and, through that passage, with conventional flushing jets 154 in pilot bit 18. Lower bores 80*a*, coaxial with axis 35 of bore 308 and shaft 34, are of sufficient diameter to permit passage of shaft 34. These communicate with plenum 150 for the purpose of permitting insertion and removal of shaft 34 within lower female connection 17. Bore 18*a* in frame portion 24 is aligned with bore 80 in shaft bushing 304. Due to the selected proportions of the lower threaded connection 17 in this embodiment, bore 80*a* intersects and removes a portion of the thread as shown at 80*b*.

Snap ring 310 in groove 312 in shaft bushing 304 retains shaft 34 axially. Seal 70 prevents fluid communication between plenum 150 and annular plenum 134. When the next lower element in the drill string, for example pilot bit 18, is connected to frame 10 via connection 17 the entire assembly, including bore 80*a* and snap ring 312, are entirely enclosed and protected from the harsh hole-bottom environment.

Figure 3:
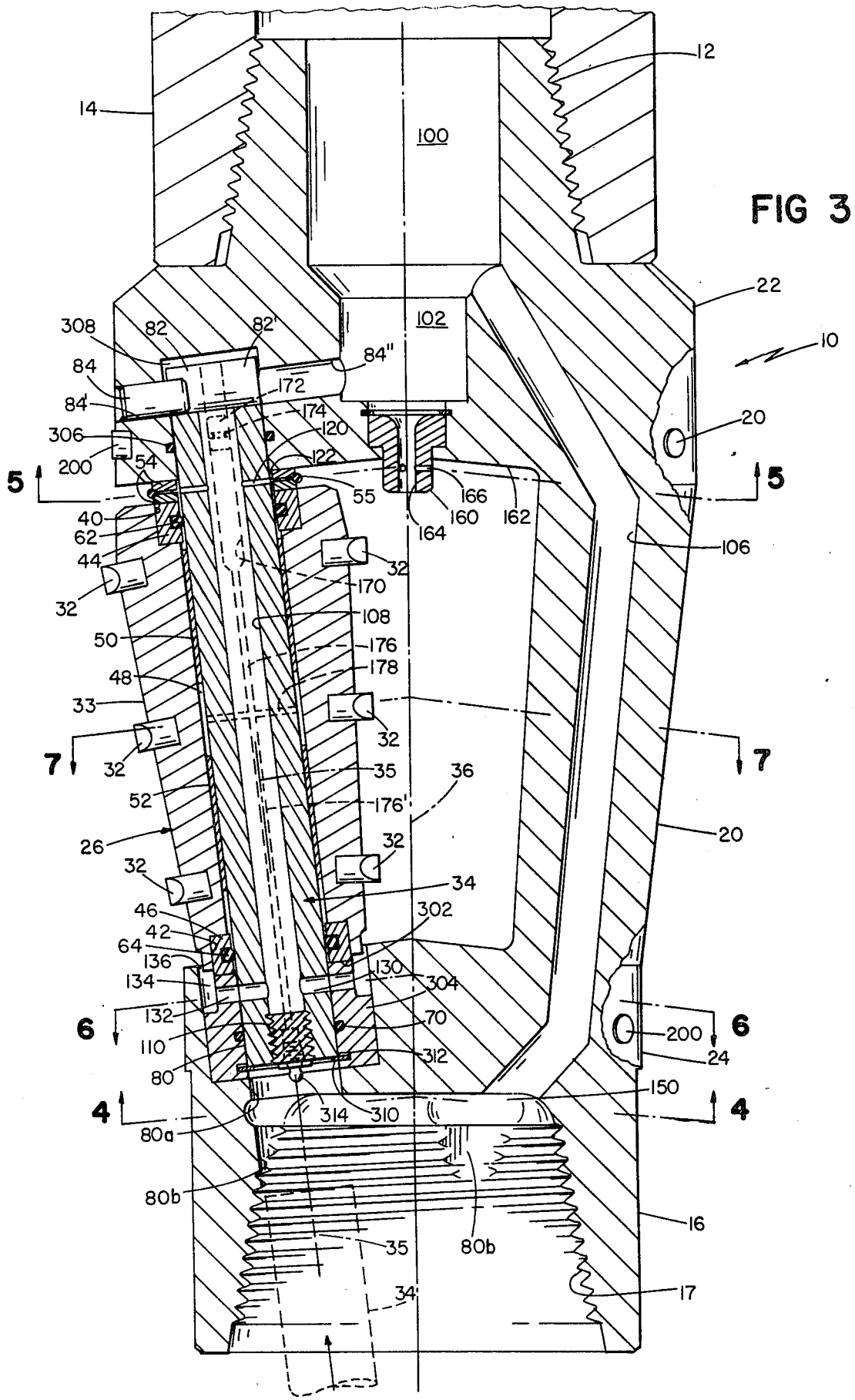
FIG. 3 is an enlarged view of a portion of FIG. 1, partially in section.

Referring still to FIG. 3, a removable jet fitting 160 extends axially through the bottom wall 162 of plenum 102. The fitting has an axial orifice 164 to project a jet of flushing fluid down the center of frame 10, adjacent the three cutters 26, and three radial orifices 166 to flush between frame wall 162 and the tops of the cutters.

A system for distribution of pressurized lubricant (e.g., grease) is also provided. A grease reservoir 170 (FIG. 3) extends in the wall of each shaft 34, parallel to passage 108. A movable pressure piston 172 is located at the upper end of each reservoir 170, with O-ring 174 providing a seal between the piston and the inner wall of the reservoir. Flushing fluid communicates with the top of piston 172 to pressurize the grease in the reservoir at the flushing fluid pressure. Lube passage 176 extends down from the reservoir, and provides grease through holes 178 to bearings 50 and 52. Extension 176' of lube passage 176 extends to the bottom end of shaft 34, terminating in grease fitting 314 to permit relubrication through the connection means 17 when pilot bit 18 (or other drill string element) is removed. Grease fittings 314 are thus also enclosed and protected from the rock-cutting environment during use.

Figure 8:
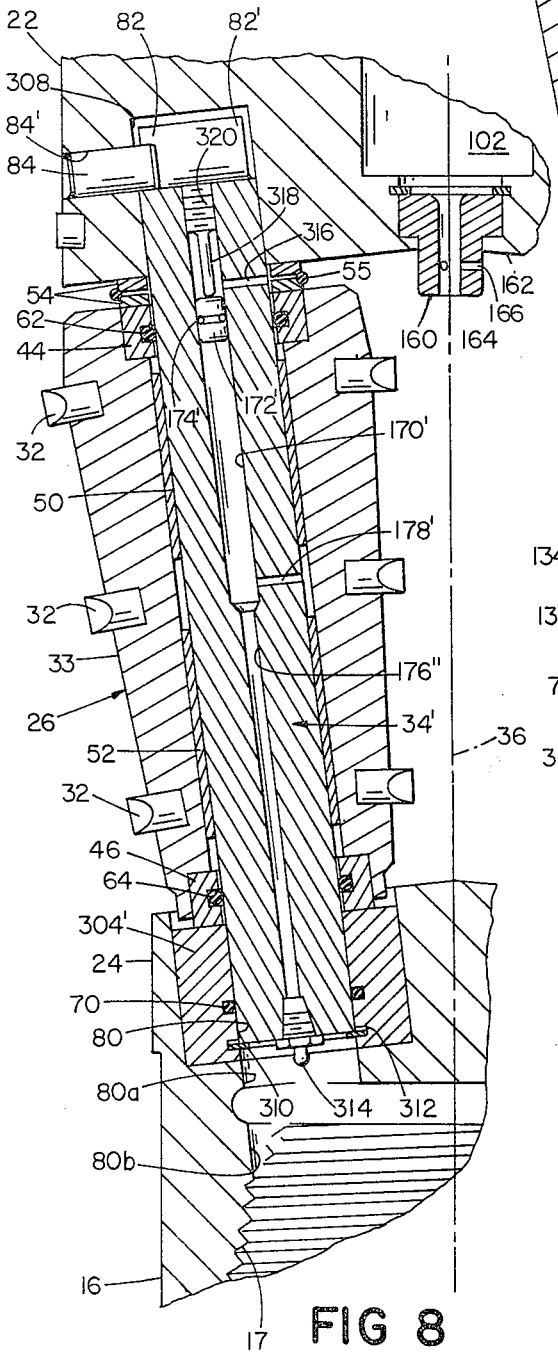
FIG. 8 is a sectional view similar to FIG. 3, of an alternate lubrication and flushing arrangement.

In some applications, such as deep oilwell drilling, the flushing fluid is drilling mud which through reuse becomes loaded with abrasive cuttings. Furthermore, this mud is often used at high pressure (i.e., 1000 psi) which is not suitable for use inside the passages described above. In such applications the configuration shown in FIG. 8 is preferred in which the internal fluid passage through cutter shaft 34 is omitted and an external grease pressure source is employed. Grease reservoir 170' extends axially within shaft 34'. A movable pressure piston 172' is located in reservoir 170', with O-ring 174' providing a seal between the piston and the inner wall of the reservoir. Plug 320 seals the upper end of reservoir 170'. The upper surface of piston 172' is pressurized to external ambient pressure by fluid (air, water, mud) leaking past O-ring 55, through hole 316, to act on the upper surface of piston 172'. Extension 318 from the plug acts against piston 172' to ensure that the latter cannot move upward far enough to allow its seal 174' to travel past hole 316. Reservoir 170' communicates through hole 178' to feed bearings 50 and 52 with grease at external ambient pressure. Extension 176'' of reservoir 170' extends to the lower end of shaft 34 where it terminates in grease fitting 314, or sealing plug.

Figure 9:
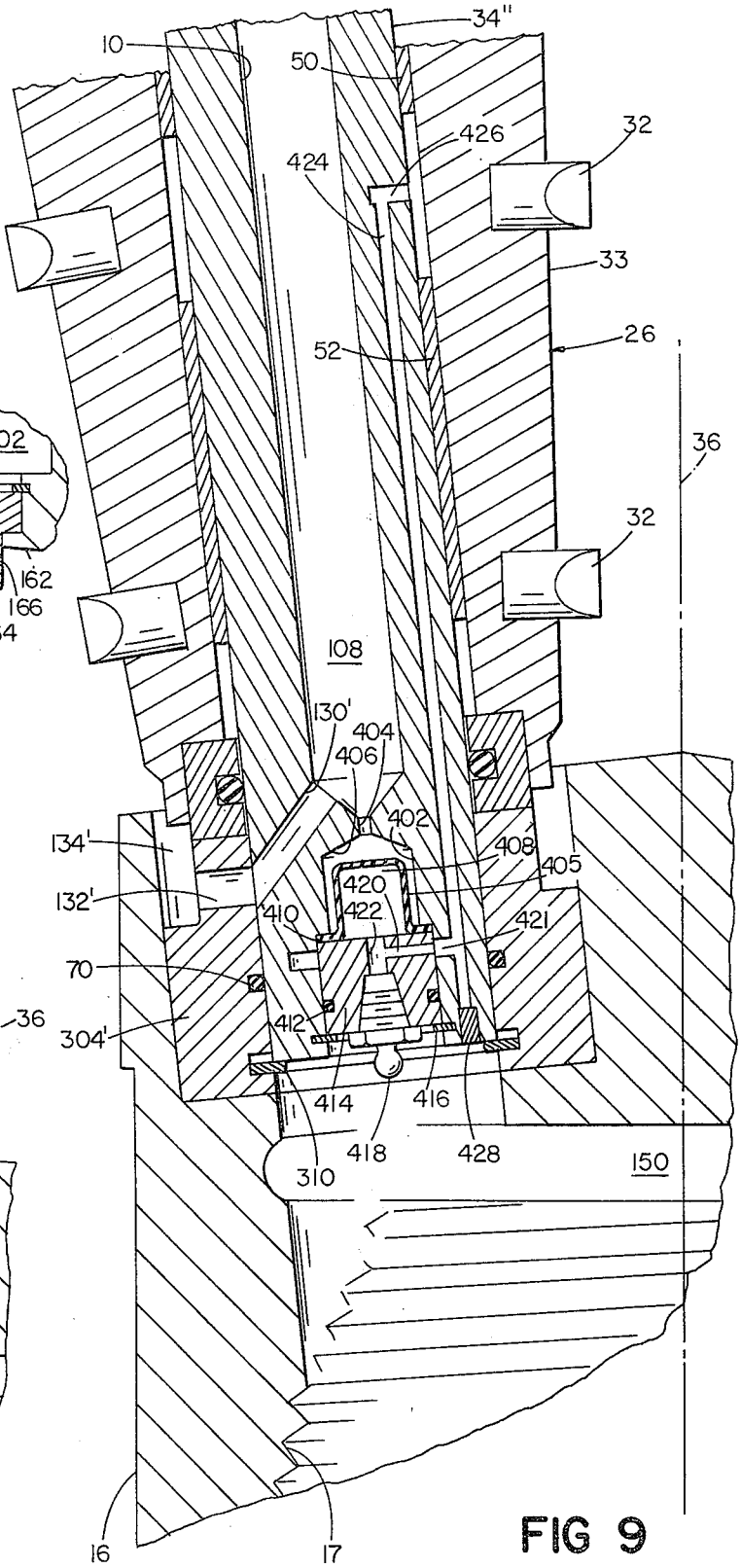
FIGS. 9, 10 and 11 are partial sectional views, similar to FIG. 3 of alternate constructions.

The grease piston 172 or 172' may be replaced by a pliable diaphragm device according to FIG. 9. In this case shaft 34'' contains central fluid passage 108', and axially aligned counterbore 402 connected by small hole 404. Central passage 108' communicates through hole 130' in shaft 34'' and hole 132' in shaft bushing 304' to plenum 134' to provide flushing fluid for the cutters. Counterbore 404 is divided by flexible diaphragm 405 into a fluid chamber 406 and a grease reservoir 408. Grease reservoir 408 communicates through hole 422 to grease fitting 418 and through holes 420, 424, and 426 to the bearings (52' and 50'). Hole 424 is plugged at 428 to prevent leakage of grease. Grease reservoir 408 is covered and retained by cover 414, with seals at 412 and 410 (a lip on diaphragm 404) on opposite sides of hole 420. Cover 414 is retained by snap ring 416 in a groove in counterbore 404. In operation, fluid pressure in passage 108', acting through hole 404 and flexible diaphragm 405 pressurizes grease in reservoir 408 and feeds bearings through the holes indicated. Regreasing is possible through fitting 418.

It will be noted that the entire frame 10 is free of major protuberances or indentations, or connection devices which would create concentrated wear points when exposed to the work. Furthermore, hard inserts (tungsten carbide) 200 are pressed into frame 10 to prevent wear.

Figure 10:
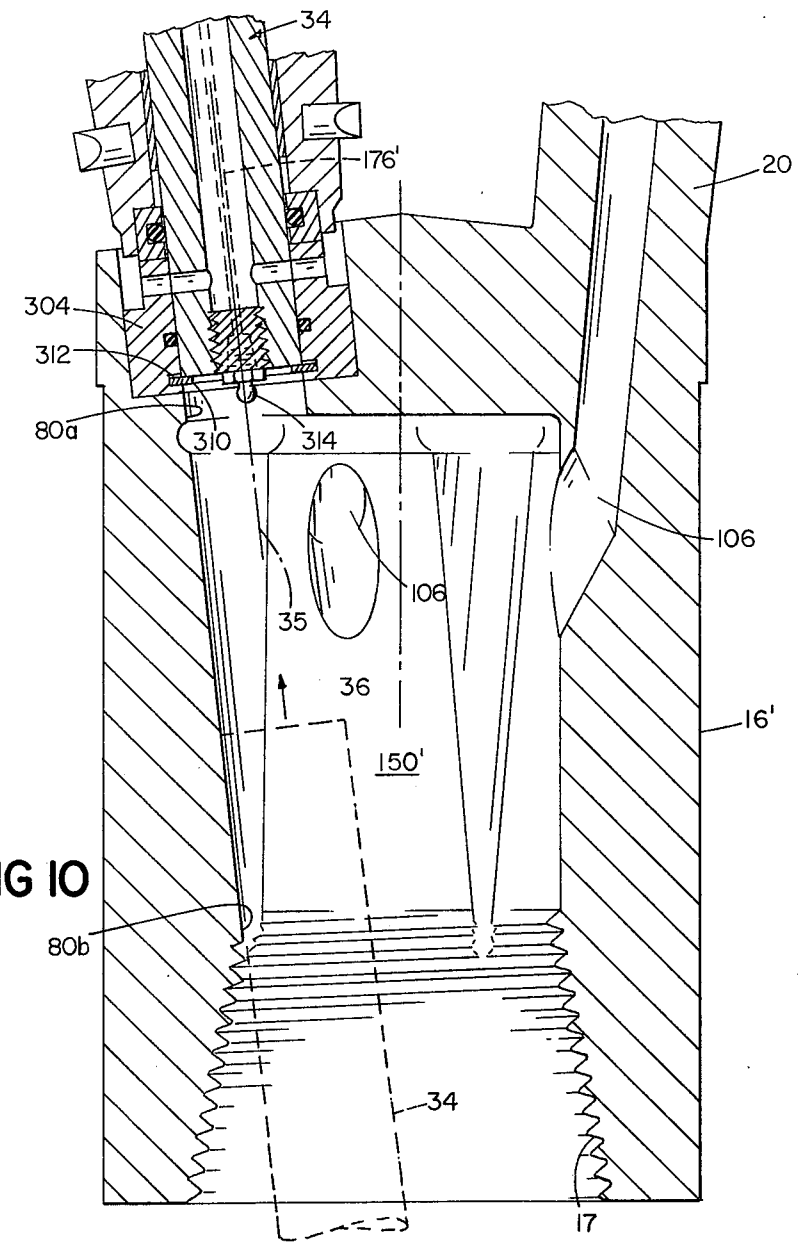

In some cases the lower connection means 17 is of small diameter and the extended bore **80*a* either cannot be contained within connection means 17 if the design follows the proportions of FIG. 3, or the cut-out portion 80*b* of the thread is too large. FIG. 10 illustrates a construction which avoids this problem. Numbers are the same as those of FIG. 3 for identical pieces. Lower frame portion 22' is lengthened, creating an extended plenum 150' between the end of shaft 34 and lower connection means 17. Bore extension 80*a* is unchanged, but because of the downwardly converging orientation of axis 35 of shaft 34, the intersection 80*b'* of shaft bore 80*a* with connection means 17 moves radially inward as the position of connection means 17 is moved downward. By this lengthening of frame portion 22', the cut-out 80*b'*** of the thread can be reduced to acceptable proportions as shown, or eliminated entirely if desired.

Figure 11:
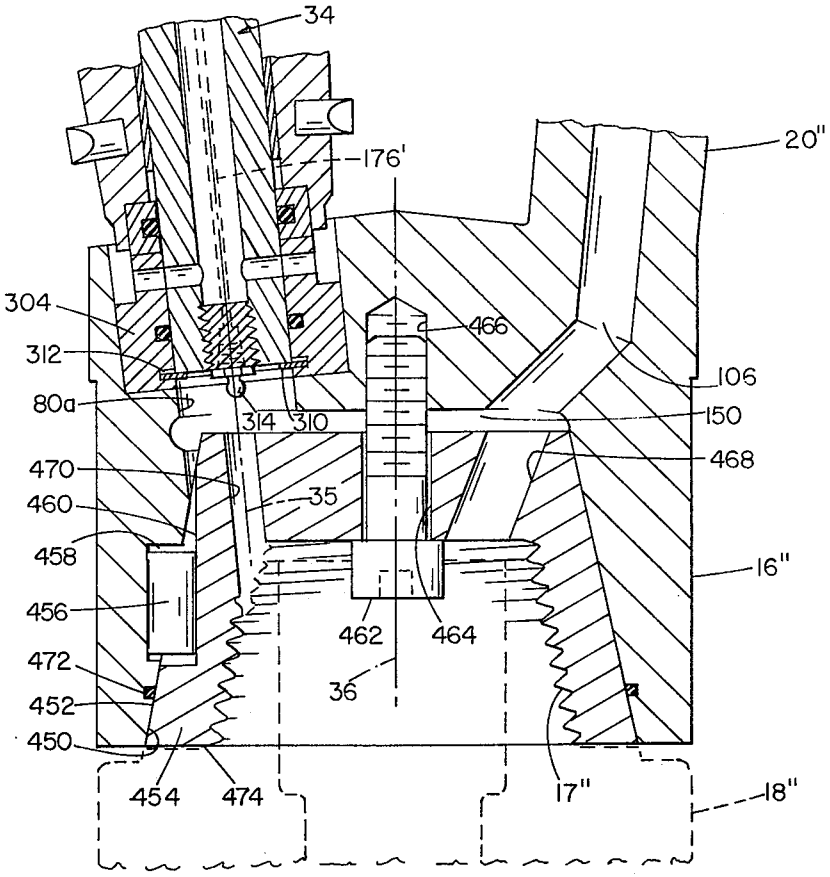

For blast hole applications extension of the frame as shown in FIG. 11 is undesirable because this extends the length of pilot bit diameter hole and thus requires deeper drilling to produce a full-size bore to the desired depth.

FIG. 11 illustrates an alternate construction which retains a short frame while avoiding cut-out of the connection thread. The frame is bored out to a tapered recess 450. Plug 454 having a matching tapered external surface 452 and threaded internal connection 17'' is inserted in recess 450. Key 456, captive (welded) in slot 458 in the side of recess 450, slidingly engages keyway 460 in plug 454 to prevent rotation of plug 454 relative to the frame. Bolt 462 passes through hole 464 in plug 454 and is threaded into frame portion 20'' at 466 to hold plug 454 in place. Holes 468 in plug 454 communicate with passages 106 in struts 20 to carry flushing fluid to pilot bit 18''. Holes 470 in plug 454, of small enough diameter to avoid excessive cut-out of connection thread 17'', are aligned with grease fitting 314 to permit regreasing without removal of plug 454. Seal 472 is provided to prevent leakage between plug 454 and recess 450.

Pilot bit 18'' seals against shoulder 474 of plug 454, protecting all of the foregoing assembly, including bolt 462 and snap rings 310, and grease fittings 314 from the harsh hole-bottom environment.

We claim:

1. Boring apparatus comprising a frame having a primary axis of rotation, and a plurality of hole-enlarging assemblies mounted on said frame and having separate axes of rotation radially outward of said primary axis, said separate axes generally converging downwardly toward said primary axis, each said assembly having a working member rotatably mounted upon an elongated shaft passing through the working member and adapted for acting upon the wall of the hole being bored, said frame having a connection means at its bottom for supporting a further element of the drill string, said connection means defining a hollow space, a passage associated with each of said hole-enlarging assemblies extending through said frame downwardly from said assembly, along the respective axis to said hollow space, said hollow space and each passage being correspondingly sized and clear of obstruction to enable insertion of the respective elongated shaft through said hollow space into said passage, thence through said working member to an upper support point to hold said working member in operating position, and retaining means for retaining said shaft in said position.

2. The boring apparatus of claim 1 wherein said retaining means is located at the lower end of said passage accessible through said hollow space, and being removable to permit removal of said shaft through said space and replacement of parts of said assembly, said removable retaining means and the respective end of said shaft being protected from the bottom-hole environment by said connection means and the further element supportable by said connection means.

3. The apparatus of claim 1 wherein the upper ends of said shafts are retained in respective passages in an integral upper portion of said frame, said frame portion having an external surface in the general form of a surface of revolution free of concentrated wear points.

4. The apparatus of claim 3 wherein said external surface is provided with hard wear-resistant inserts.

5. The apparatus of claim 1 wherein the lower portion of said frame defining said passages through which said shafts are inserted and said connection means have external surfaces in the general form of surfaces of revolution free of concentrated wear points.

6. The apparatus of claim 5 wherein said external surfaces are provided with hard wear-resistant inserts.

7. The apparatus of claim 1 wherein said connection means defines an internal thread, said passages extending along said converging axes passing partially through portions of said thread.

8. The apparatus of claim 1 wherein said frame includes an integral hollow lower extension preceding said connection means, the opening from said space to said passage being through the inside wall of said extension.

9. The apparatus of claim 1 wherein said connection means is formed of two parts, an outer part integral with and extending downwardly from upper portions of said frame, said part defining an outer wear surface and said hollow space through which said shaft is inserted, and a second part secured within the hollow space of said first part and defining internal threads for connection of said further element of the drill string.

10. The apparatus of claim 1 wherein each of said shafts contains a lubricant reservoir, and a lubricant fill point is provided at the lower end of each said shaft, accessible for refilling through the respective passage, conduits in each said shaft extending from said reservoir to bearings supporting said working member on said shaft, said lubricating reservoir and conduits being thereby installable by insertion of said shaft through said passage.

11. The apparatus of claim 10 including a pressurized flushing fluid supply passage and means exposing a movable pressurizing member in said reservoir in said shaft to fluid from said supply passage to pressurize lubricant in said shaft.

12. The apparatus of claim 10 constructed in accordance with claim 9, wherein a passage is provided in said second part to provide access through said second part to said lubrication fill point.

13. The apparatus of claim 10 wherein said pressurizing member comprises a diaphragm located within the lower end of the shaft.

14. The apparatus of claim 11 wherein said flushing fluid passage is adapted to convey abrasive-free fluid and includes a fluid passage extending through each said shaft to a flushing outlet, and a conduit from the latter said fluid passage to apply said fluid to said pressurizing member.

15. In the apparatus of claim 1 in which each of said assemblies comprises thrust bearings disposed within the opposite ends of the respective working member, radial bearing means in the working member between said thrust bearings supporting said working member on the respective shaft, and shaft seals associated with each of said thrust bearings, the improvement wherein each of said shafts contains a lubricant reservoir, conduits in said shaft extending from said reservoir to the space between said thrust bearings, a pressurized flushing fluid supply passage and means exposing a movable pressurizing member in said reservoir in said shaft to fluid from said supply passage to pressurize lubricant in said shaft, thus to apply lubricant pressure on the inside surfaces of said seals, means surrounding said shaft defining a buffer chamber on the outside surface of at least one of said seals and means for applying fluid at reduced pressure to said buffer chamber.

16. The apparatus of claim 15 wherein said flushing fluid passage is adapted to convey abrasive-free fluid and includes a fluid passage extending through each said shaft to a flushing outlet, and a conduit from said latter mentioned fluid passage to apply said fluid to said pressurizing member, and a further conduit, downstream of said conduit that extends to said reservoir, conducting said flushing fluid to said buffer chamber.

17. Boring apparatus comprising a frame having a primary axis of rotation, and a plurality of hole-enlarging assemblies mounted on said frame and having separate axes of rotation radially outward of said primary axis, said separate axes generally converging downwardly toward said primary axis, each said assembly having a working member rotatably mounted upon an elongated shaft passing through the working member and adapted for acting upon the wall of the hole being bored, said frame having a connection means at its bottom for supporting a further element of the drill string, said connection means defining a hollow space, a passage associated with each of said hole-enlarging assemblies, extending through said frame downwardly from said assembly, along the respective axis to said hollow space, said hollow space and each passage being correspondingly sized and clear of obstruction to enable insertion of the respective elongated shaft through said hollow space into said passage, thence through said working member to an upper support point to hold said working member in operating position, and retaining means for retaining said shaft in said position, said retaining means for each shaft being located at the lower end of the respective passage accessible through said hollow space, and being removable to permit removal of the shaft through said space and replacement of parts of said assembly, said removable retaining means and the respective end of the shaft being protected from the bottom-hole environment by said connection means and the further element supportable by said connection means and the upper ends of said shafts being retained in respective passages in an integral upper portion of said frame.

* * * * *